US006716202B1

(12) United States Patent
Hood

(10) Patent No.: US 6,716,202 B1
(45) Date of Patent: Apr. 6, 2004

(54) SKIN CLEANING METHOD

(75) Inventor: Shirley Ann Hood, G 3100 Miller Rd. #6C, Flint, MI (US) 48507-1310

(73) Assignee: Shirley Ann Hood, Flint, MI (US)

( * ) Notice: Subject to any disclaimer, the term of this patent is extended or adjusted under 35 U.S.C. 154(b) by 204 days.

(21) Appl. No.: 09/591,839

(22) Filed: Jun. 12, 2000

Related U.S. Application Data

(60) Provisional application No. 60/140,683, filed on Jun. 24, 1999.

(51) Int. Cl.[7] ..... A61M 35/00; B43L 21/00; A47K 7/02

(52) U.S. Cl. ..... 604/290; 15/209.1; 15/222

(58) Field of Search ..... 15/209.1, 208, 15/227, 209, 230.15, 223, 210–211, 225–226, 210.5, 229, 229.11, 188, 160; 206/77.1; 473/614; 132/200; 401/7, 201; 604/290

(56) References Cited

U.S. PATENT DOCUMENTS

| | | | | |
|---|---|---|---|---|
| 2,893,029 A | | 7/1959 | Vosbikian et al. | |
| 3,060,478 A | | 10/1962 | Silver | |
| 3,514,802 A | * | 6/1970 | Keech | 15/118 |
| 4,303,543 A | * | 12/1981 | Mansy | 132/200 |
| 4,761,849 A | * | 8/1988 | Taylor | 15/222 |
| 4,829,622 A | | 5/1989 | O'Sullivan | |
| 4,980,943 A | * | 1/1991 | Barber | 15/227 |
| 5,029,357 A | | 7/1991 | Gootoff et al. | |
| 5,465,452 A | * | 11/1995 | Girardot et al. | 15/209.1 |
| 5,491,864 A | * | 2/1996 | Tuthill et al. | 15/118 |
| 5,687,447 A | | 11/1997 | Bynum et al. | |
| 5,787,542 A | | 8/1998 | Chien | |
| 5,983,435 A | * | 11/1999 | Osborne | 15/209.1 |
| 6,109,070 A | * | 8/2000 | Chen | 66/174 |
| 6,156,418 A | * | 12/2000 | Girardot et al. | 15/208 |

FOREIGN PATENT DOCUMENTS

JP 02200857 A * 8/1990

OTHER PUBLICATIONS

Hatch, Kathryn L., Textile Science, 1993, West Publishing Company, pp 234–243.*

Blanchard, Nanette, "Garter Stitch Eyelet Facecloth", Mar. 9, 1996, http://members.aol.com/DNott97553/knit.html.*

* cited by examiner

*Primary Examiner*—Weilun Lo
*Assistant Examiner*—Linh Truong
(74) *Attorney, Agent, or Firm*—Reising, Ethington, Barnes, Kisselle & Learman, PC

(57) ABSTRACT

The skin cleaning method employs a skin cleaning aid knitted from an acrylic yarn using a garter stitch. The garter stitch creates surfaces with ridges and voids that pass through the cleaning aid. A cleanser and water form a lather that fills some of the voids. When using the skin cleaner, abrasive acrylic fibers scrape lather and dead skin cells from the skin and deliver the lather and dead skin cells to an adjacent void. Additional lather is applied to the skin that was scraped by an acrylic fiber.

2 Claims, 1 Drawing Sheet

FIG-1
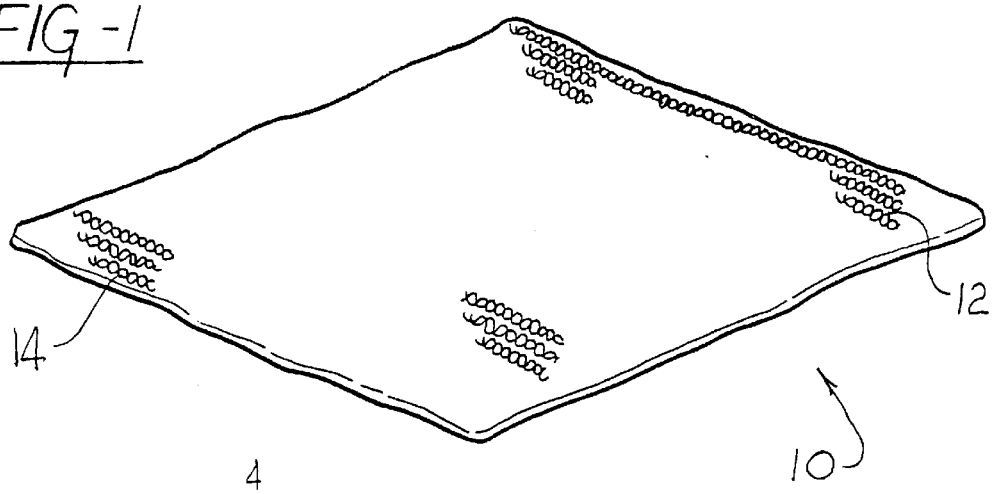
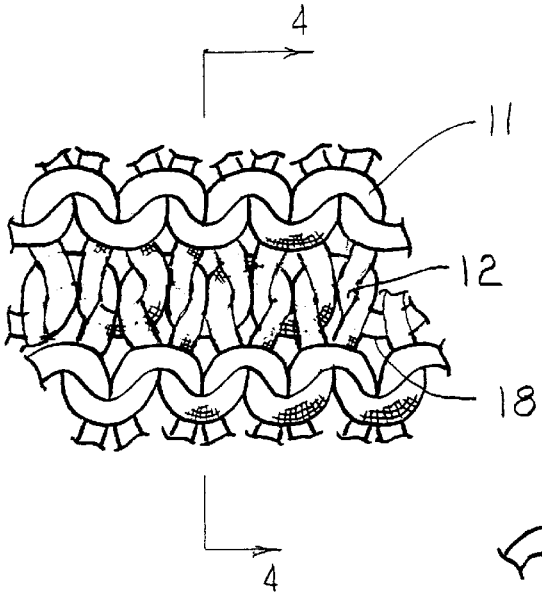
FIG-2
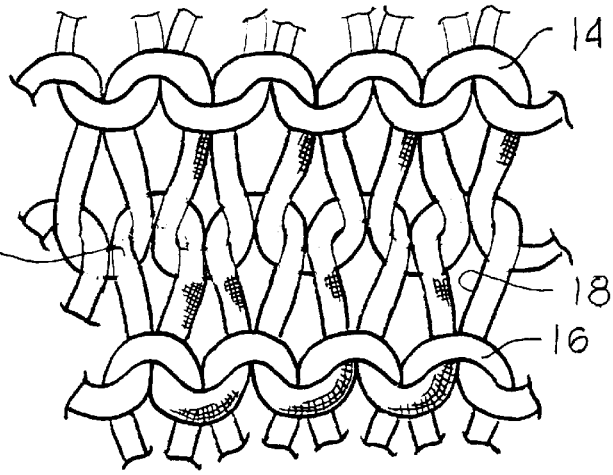
FIG-3
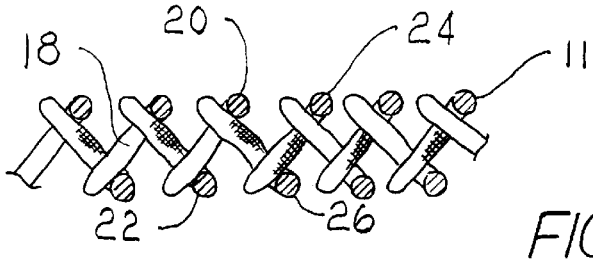
FIG-4

SKIN CLEANING METHOD

The disclosure incorporates the skin cleaning method disclosed in provisional patent application No. 60/140,683, filed Jun. 24, 1999, whose priority is claimed for this application.

TECHNICAL FIELD

The skin cleaning method employs a knitted member made from acrylic yarn with abrasive fiber and large voids that hold lather and carry dead skin cells, removed by the abrasive fibers, away from the surface of living skin.

BACKGROUND OF THE INVENTION

Cells that make up the skin of humans are constantly dying and being replaced by new skin cells. When bathing it is desirable to remove dead skin cells. Most bathers leave dead skin cells on the outer surface of their skin when bathing.

A large percentage of individuals rub some soap on their skin with their hands and then rinse the soap off with water. This leaves many dead skin cells attached and in place. Brushes are occasionally employed with soap to clean hands and fingers. Brushes are okay on volar surfaces but are not suitable for use on most skin. Brushes tend to remove some living cells and to miss dead cells in wrinkles, creases, and other protected and tender areas.

Substantial numbers of people employ soft cotton washcloths. These cloths are far better than a bar of soap and the hands. However, cotton soaks up water and the surfaces of cotton washcloths that touches the skin tends to become smooth, flat, and slick. Soap on a cotton material tends to act as a lubricant and hold cotton fibers out of contact with the skin. Any dead skin cells that are loosened tend to be held in contact with the live skin cells and are not carried away from the skin by the action of the soap.

Nylon nets have come into use for cleaning various surfaces, including skin. They are superior to cotton washcloths. However, nylon net has some shortcomings. A single sheet of nylon netting tends to let soap pass through. When cleaning skin you end up rubbing the skin with the net material with little or no soap. To correct this problem, multiple layers of netting are put together. Soap still tends to pass through the outer portions of the netting. The soap can be returned to the outer netting surfaces by squeezing the multiple layers.

Multiple layers of nylon netting tend to hold foreign material. It is at best too difficult to remove foreign matter from between layers of nylon netting.

SUMMARY OF THE INVENTION

The skin cleaning method employs a cleanser, water, and a skin cleaning aid knitted from a yarn made of a plurality of abrasive synthetic fibers employing a garter stitch. A cleanser and water are applied to the skin cleaning aid to fill a plurality of the voids in the skin cleaning aid with a lather formed by the cleanser and water. An area of skin to be cleansed is rubbed with a skin cleaning aid to apply the lather from the plurality of voids to the area of the skin. A plurality of dead skin cells and lather are scraped from the area to be cleaned by moving a plurality of abrasive synthetic fibers across the area of skin. Dead skin cells and lather are carried away from the surface of the area of skin that is being cleaned and into the plurality of voids. Additional lather is applied to the area of the skin that is being cleaned following the scraping of lather and a plurality of dead skin cells from the surface by at least some of the plurality of abrasive synthetic fibers. The lather and dead skin cells are rinsed from the area of skin that is being cleaned. Lather and dead skin cells are also rinsed from the skin cleaning aid.

The garter stitch employed in the knitted skin cleaning aid has a plurality of voids which increase in area when the cleaning aid is stretched. An acrylic yarn has been found to work well in the cleaning aid.

BRIEF DESCRIPTION OF THE DRAWINGS

The presently preferred embodiment of the invention is disclosed in the following description and in the accompanying drawings, wherein:

FIG. 1 is a perspective view of a knitted material used for a skin cleaning aid;

FIG. 2 is an enlarged plan view of the knitted material;

FIG. 3 is plan of view of a section of the knitted material that is under tension; and FIG. 4 is a sectional view taken along Line 4—4 in FIG. 2.

DETAILED DESCRIPTION OF THE PREFERRED EMBODIMENT

The skin cleaning aid 10 is a rectangular member knitted from a synthetic yarn 11. Synthetic yarns are made from a variety of man made fibers. Many of these man made fibers are abrasive and exceptionally strong. KEVLAR®, when woven into a cloth for example, can stop a bullet fired from a gun. When woven into a fishing line, KEVLAR® is sufficiently abrasive to cut grooves in metal and other materials.

Yarns woven from acrylic fibers is sufficiently abrasive to remove dead skin and many other undesirable materials from human skin. The acrylic yarns do not absorb water. As a result they dry quickly and generally do not become soured or mildewed. A four-ply and four ounce, ORLON®, acrylic fiber works well in the skin cleaning aid 10.

The acrylic yarn employed to make the skin cleaning aid 10 is knitted using a garter stitch. The garter stitch forms a relatively rough surface with parallel ridges and large voids 12. Each two knitted rows form a ridge. The front face surface is the same as rear face surface of the skin cleaning aid 10. Some of the voids 12 become apertures 18 and pass completely through the skin cleaning aid 10. The garter stitch as shown in FIG. 4 provides a relatively thick member with voids that extend from the two outer surfaces into and through the skin cleaning aid 10.

Stretching the skin cleaning aid 10 along a line parallel to the section line 4—4 in FIG. 2 separates the loops 14 and 16 and increases the size of the apertures 18 as shown in FIG. 3. Stretching the skin cleaning aid along a line perpendicular to the section line 4—4 in FIG. 2 also increases the size of the apertures 18. Separating loops 20 and 22 from loops 24 and 26 shown in FIG. 4 will clearly increase the size of the apertures 18. It will also tend to reduce the thickness of the cleaning aid 10. The increase of the size of voids 12 and the apertures 18 due to stretching the skin cleaning aid 10 maintains the voids 12 that hold soap and detergent. The reduction in thickness of the cleaning aid 10 tends to move lather formed from the soap or detergent and water in the voids 12 into contact with the skin that is being cleaned.

To clean human skin, the area to be cleaned is moistened. The skin cleaning aid 10 is also moistened. Rubbing the cleaning aid 10 on a bar of soap or detergent or applying liquid soap or detergent to the cleaning aid tends to fill the voids 12 with lather.

After the skin cleaning aid 10 is at least partially filled with lather the skin area to be cleansed is gently rubbed with the skin cleaning aid. The voids 12 in the cleaning aid 10 apply a coating of lather to the skin. The abrasive fibers in the next strand of yarn gently scrapes the skin surface removing the cleanser, dead skin cells, and foreign material. The cleanser, water, and material removed from the skin surface by abrasive fibers moves into the voids 12. Cleanser and water in the voids 12 following the fibers that scrape the skin is forced into contact with the skin for further cleansing.

The cleanser, dead skin, and foreign material is easily rinsed from the skin cleaning aid 10 with either cold or warm water. Following rinsing, the skin cleaning aid 10 is draped over a bar or line and air-dried. The skin cleaning aid 10 can also be dried in a clothes dryer if desired.

The disclosed embodiment is representative of a presently preferred form of the invention, but is intended to be illustrative rather than definitive thereof. The invention is defined in the claims.

What is claimed is:

1. A skin cleaning method employing cleanser, water, and a skin cleaning aid knitted from a yarn including a plurality of acrylic fibers employing a garter stitch that forms a plurality of generally parallel ridges each having a plurality of outwardly facing yarn loops, a plurality of generally parallel voids each of which is between two of the plurality of generally parallel ridges, and wherein each of the plurality of generally parallel ridges and each of the plurality of generally parallel voids extends from a first cleaning aid edge to a second cleaning aid edge comprising:

applying a cleanser and water to said skin cleaning aid to at least partially fill the plurality of generally parallel voids in said skin cleaning aid with a lather formed by the cleanser and water; rubbing an area of skin to be cleansed with said skin cleaning aid to apply the lather from the plurality of voids to the area of skin; scraping lather and a plurality of dead skin cells from the area of skin to be cleansed by moving the plurality of acrylic fibers, in the yarn forming the plurality of generally parallel ridges, across the area of skin; carrying dead skin cells and lather away from the surface of the area of skin that is being cleansed and into the plurality of voids; applying additional lather to the area of skin that is being cleansed following the scraping of lather and the plurality of dead skin cells from the surface by at least some of the plurality of acrylic fibers; rinsing lather and dead skin cells from the area of skin to be cleansed; and rinsing lather and dead skin cells from the plurality of voids in said skin cleaning aid.

2. A skin cleaning method set forth as in claim 1 including increasing the area of voids in the said skin cleaning aid by stretching said skin cleaning aid.

* * * * *